United States Patent [19]

Hager

[11] Patent Number: 4,979,619

[45] Date of Patent: Dec. 25, 1990

[54] PROTECTIVE CASE FOR COLLECTIBLE SPORTS CARDS

[76] Inventor: Alan C. Hager, 65 High Ridge Rd., Suite 227, Stamford, Conn. 06905

[21] Appl. No.: 468,052

[22] Filed: Jan. 22, 1990

[51] Int. Cl.[5] ..... B65D 85/62; H45G 11/00

[52] U.S. Cl. ..... 206/509; 206/39; 206/45.34; 40/156; 150/145; 150/147; 220/DIG. 31

[58] Field of Search ..... 40/156, 154; 206/508, 206/509, 503, 39, 449, 45.31, 45.34; 150/145, 147

[56] References Cited

U.S. PATENT DOCUMENTS

| | | | |
|---|---|---|---|
| 896,753 | 8/1908 | Peterson | 40/156 |
| 3,034,640 | 5/1962 | Evans | 206/45.34 |
| 3,255,870 | 6/1966 | Peck | 206/45.34 |
| 4,320,831 | 3/1982 | Szabo et al. | 206/503 X |
| 4,518,080 | 5/1985 | Ohlson | 40/156 X |
| 4,545,486 | 10/1985 | Bostic | 206/45.34 |
| 4,918,299 | 4/1990 | Ohmori | 150/147 X |

FOREIGN PATENT DOCUMENTS

| | | | |
|---|---|---|---|
| 3110129 | 11/1981 | Fed. Rep. of Germany | 206/45.31 |

*Primary Examiner*—William I. Price
*Attorney, Agent, or Firm*—Norman B. Rainer

[57] ABSTRACT

A transparent plastic case is provided for the protective long term storage of sports cards. The case is comprised of front and rear panels of matching elongated rectangular perimeter adapted to be cohesively sealed to enclose a sports card and a documentation card. The dimensions of the case relative to the sports card are such that the sports card within a sealed case is free to move slightly. The panels are further configured to facilitate stacking of a number of the cases.

8 Claims, 3 Drawing Sheets

PROTECTIVE CASE FOR COLLECTIBLE SPORTS CARDS

BACKGROUND OF THE INVENTION

This invention relates to the protective long term storage of flat collectible items, and more particularly concerns a protective case for the storage of sports cards.

Whether as a hobby or for investment purposes, there is considerable interest in collecting sports cards. Such cards are generally of elongated rectangular shape, and depict professional Players in sports such as baseball, football, basketball, hockey, soccer, wrestling, tennis and other sports. The depiction is generally in the form of photographs which appear on both faces of the card. Performance statistics, team affiliation, special accomplishments and other information relevant to the player and/or sport may also be printed on either or both faces of the card.

The economic value of the card is dependent primarily upon its age, physical condition and rarity. Service companies are available for providing accurate and consistent appraisal and authentication of sports cards. One such service company is Acu-Card, Inc. of Stamford, Connecticut. Culminating their review, the service company will encase the card to preserve its attested authenticity and to protect it from physical damage. The cases utilized for such purpose are fabricated of transparent flat plastic panels and further provide for incorporation within the case of documentary indicia supplied by the service company. Such documentary indicia, generally printed on card stock, may include a catalog number, date of issue, and name of the service company.

Earlier known cases, however, have not been tamper-proof and have contributed to the deterioration of the colors of the pictures on the card in the course of long term or archival storage. For example, solvent vapors from glues employed for the sealing of the cases have been found to be deleterious to the picture in long term storage. Also, during encasement, earlier cases and methods for their use have caused damage to the corners of the card. In storage cases wherein two flat plastic panels are tightly pressured against an intervening sports card, it has been found that after several years, the surfaces of the card may adhere to the plastic.

It is accordingly an object of the present invention to provide a case for a sports card which is substantially tamper-proof and provides long-term protection of the card.

It is another object of this invention to provide a case as in the foregoing object which may be readily sealed without causing immediate or long term damage to the card.

It is a further object of the present invention to provide a case of the aforesaid nature which is stackable with other cases of the same construction.

It is a still another object of this invention to provide a case of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a case for protectively confining sports cards, comprised of:

(a) a front panel fabricated of transparent plastic and having: (1) an elongated rectangular perimeter defined by upper and lower short edges and long side edges, (2) an outer face having a first upraised ridge of rectangular contour disposed adjacent said perimeter and uniformly spaced therefrom by a margin region, and (3) an interior face having an upraised lip formed as a continuous integral extension of said edges and directed in opposite relationship to said first ridge, and (b) a rear panel fabricated of transparent plastic and having: (1) an elongated rectangular perimeter identical to the perimeter of said first panel and defined by upper and lower short edges and long side edges, (2) an outer face having a second upraised ridge contiguous to said perimeter and of a rectangular contour slightly larger than the rectangular contour of said first upraised ridge, and (3) an interior face having upraised portions uniformly spaced from said edges and defining a first rectangular holding zone for accommodating a sports card and having an axis of elongation perpendicular to said short edges, and a second holding zone adjacent said upper short edge, whereby (c) when the interior faces of the front and rear panels are brought into facing relationship, the upraised lip of said front panel snugly embraces the upraised portions of said rear panel, and permits cohesive interbonding of the edges of both panels.

In a preferred embodiment, the second rectangular holding zone has an axis of elongation perpendicular to said side edges. The corners of said first holding zone are preferably recessed outwardly from the holding zone.

The present invention is based in part upon the discovery that fixed contact of the card with the plastic must be avoided in order to prevent long term damage of the card. Accordingly, the distance of separation of the interior faces of the interbonded panels, and the dimensions of the first holding zone are such as to permit some sliding movement of the card in the sealed case.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
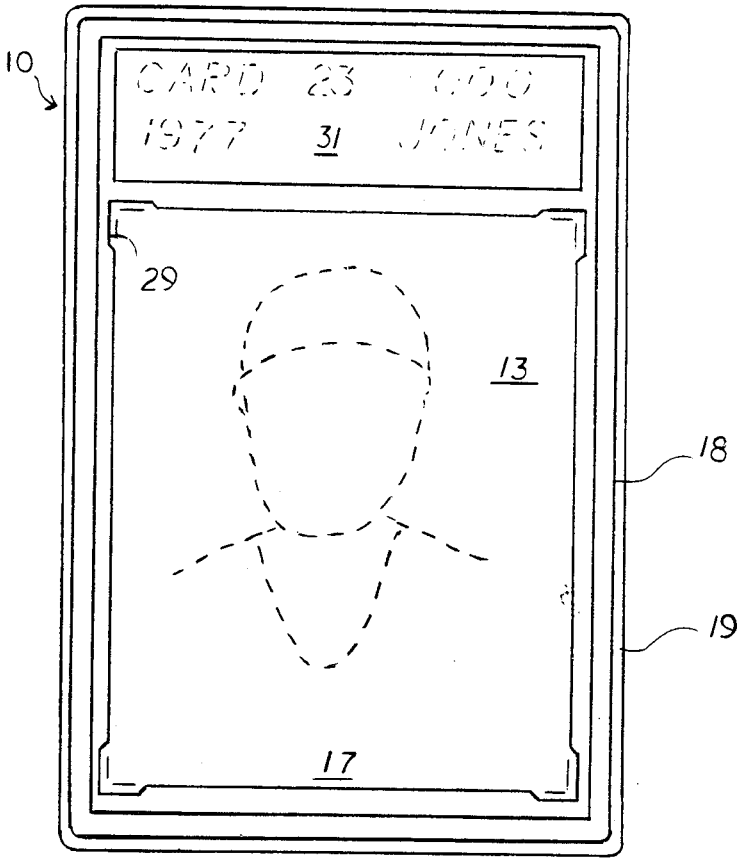
FIG. 1 is a front view of an embodiment of the case of this invention shown functionally engaging a sports card.
Figure 2:
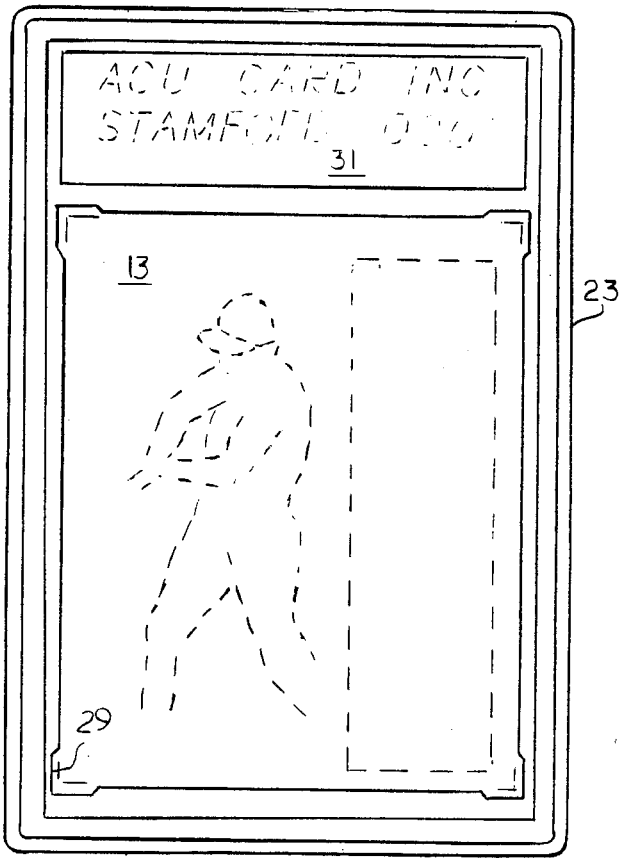
FIG. 2 is a rear view of the case of FIG. 1.
Figure 3:
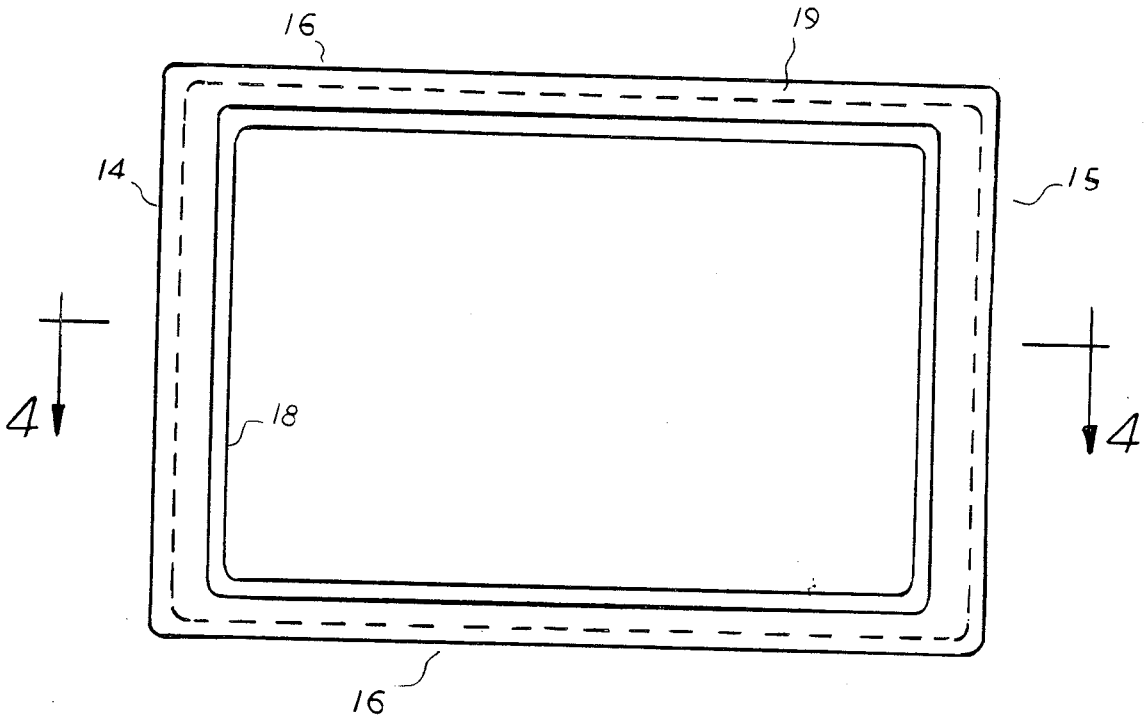
FIG. 3 is a plan view of the inside face of the front panel component of the case of FIG. 1.
Figure 4:
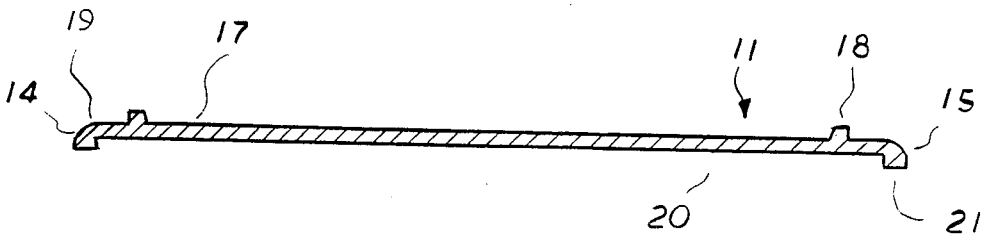
FIG. 4 is a sectional view taken upon the line 4—4 of FIG. 3.
Figure 6:
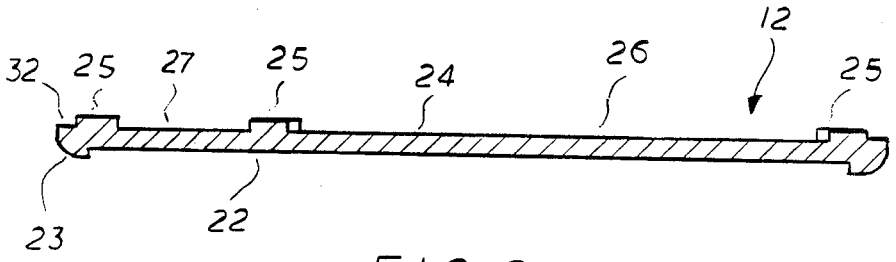
FIG. 6 is a sectional view taken upon the line 6—6 of FIG. 5.
Figure 5:
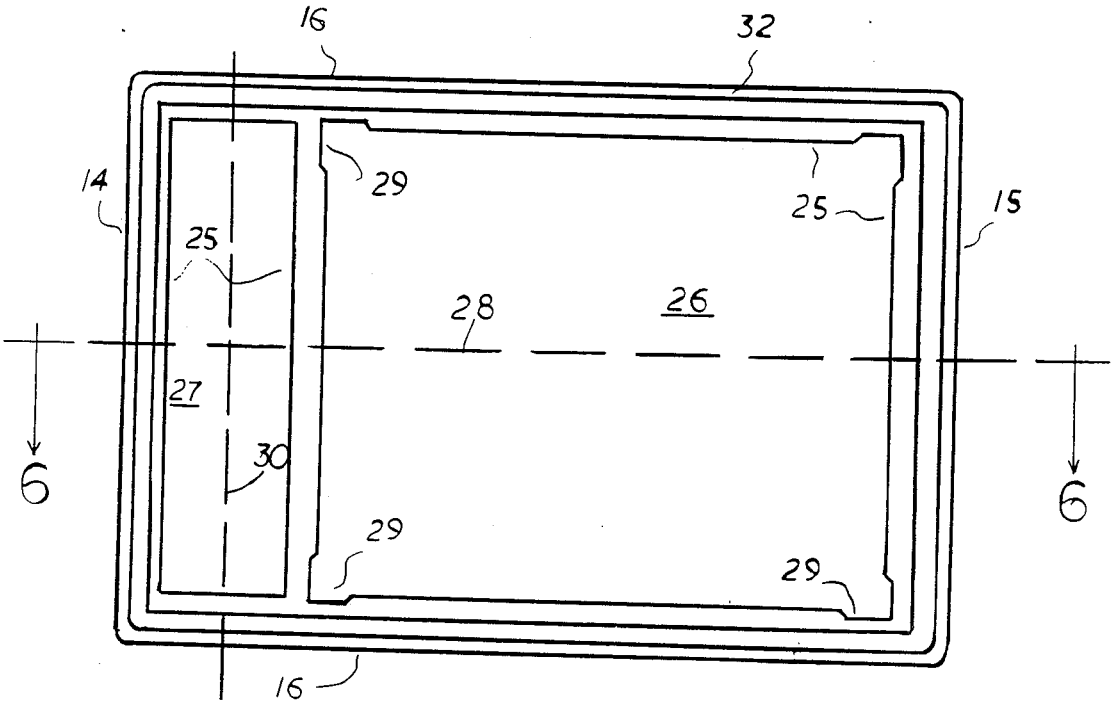
FIG. 5 is a plan view of the inside face of the rear panel component of the case of FIG. 1.
Figure 7:
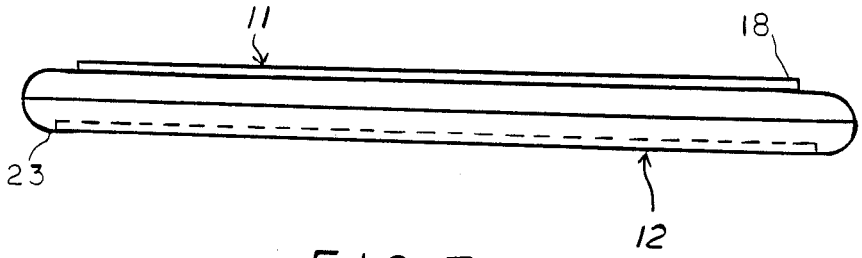
FIG. 7 is a side view of the case of FIG. 1.

Referring to FIGS. 1–7, an embodiment of the case 10 of the present invention is shown comprised of front panel 11 and rear panel 12 which sandwich therebetween sports card 13 and documentation card 31.

Front panel 11 is fabricated of transparent plastic such as polyacrylate, polycarbonate and other resins having thermoplastic characteristics. The panels may be fabricated from suitable resins by molding, stamping or equivalent shaping methods. Panel 11 has an elongated rectangular perimeter defined by upper and lower short edges 14 and 15, respectively, and long side edges 16, all of said edges being rounded. The outer face 17 of panel 11 has a first upraised ridge 18 of rectangular contour disposed adjacent said perimeter and uniformly spaced therefrom by margin region 19. The interior face 20 of panel 11 has an upraised lip 21 formed as a continuous integral extension of said edges and directed in opposite relationship to ridge 18.

Rear panel 12 is fabricated of the same plastic material as front panel 11, and is also identical in its rectangular perimeter. The outer face 22 of panel 12 has a second upraised ridge 23 contiguous to said perimeter and of a rectangular 0 contour slightly larger than the rectangular contour of first upraised ridge 18. The interior face 24 of panel 12 has upraised portions in the form of flat and straight shoulders 25 uniformly spaced from said edges by margin region 32 and defining first rectangular holding zone 26 and second holding zone 27. Zone 26 has an axis of elongation 28 which is perpendicular to short edges 14 and 15, and is adapted to confine sports card 13 while permitting slight movement thereof between shoulders 25. Each corner of zone 26 is Provided with an outwardly directed recess 29 which accommodates the corners of sports card 11 in non-contacting relationship with shoulders 25.

Second holding zone 27, adapted to hold documentation card 31, is located adjacent upper short edge 14 and has an axis of elongation 30 which is perpendicular to side edges 16.

The front and rear panels are configured such that, when brought together with the interior faces in facing juxtaposition, lip 21 of the front panel abuts against margin region 32 of said rear panel. At said site of abutment which is essentially the perimeter of the case, cohesive interbonding of the panels can be achieved. Such interbonding involves the use of ultrasonic or microwave energy which causes the abutting surfaces to establish secure bonding, generally by fusion at the miscroscopic level. Such bonding therefore does not involve the use of solvents or glues which may introduce harmful levels of contaminents into the sealed case. Equipment for achieving such bonding or welding of plastic is well known. Any gases generated by the melting of the plastic are forced out of the case before sealing. In order to further ensure the archival storage stability of the encased sports cards, the welding or sealing operation may be conducted in a blanketing environment of an inert gas such as dry nitrogen, helium and the like.

The preferred interbonding involves a two stage sealing achieved by ultrasonic techniques and referred to as shear joint welding. In the first stage, partial melting and consequent welding is achieved, allowing gases generated by the melting to exit from the corners of the case. In the second stage, the corners are welded to complete the sealing operation.

The dimensions of holding zone 26 are such that an encased sports card is free to slide a distance of at least 0.01 inch toward any edge. It is therefore important that the height of shoulders 25 and their spacing be adjusted to properly accommodate sports cards of matching dimensions.

When two or more of the cases are stacked so that all front and rear panels are identically oriented, the second upraised ridge 23 of rear panel 12 will seat upon margin region 19 of the front panel of the next underlying case. Such seating relationship provides lateral stability to any stack of the cases. In preferred embodiments, ridge 23 and margin region 19 will have a roughened texture which further promotes interlocking of the cases.

The cases are amenable to reviewable display in collection form in sleeves and other holder devices that may be held together by binder devices.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A case for protectively confining sports cards, comprised of:

(a) a front panel fabricated of transparent plastic and having: (1) an elongated rectangular perimeter defined by upper and lower short edges and long side edges, (2) an outer face having a first upraised ridge of rectangular contour disposed adjacent said perimeter and uniformly spaced therefrom by a margin region, and (3) an interior face having an upraised lip formed as a continuous integral extension of said edges and directed in opposite relationship to said first ridge, and (b) a rear panel fabricated of transparent plastic and having: (1) an elongated rectangular perimeter identical to the perimeter of said first panel and defined by upper and lower short edges and long side edges, (2) an outer face having a second upraised ridge contiguous to said perimeter and of a rectangular contour slightly larger than the rectangular contour of said first upraised ridge, and (3) an interior face having upraised portions uniformly spaced from said edges and defining a first rectangular holding zone for accommodating a sports card and having an axis of elongation perpendicular to said short edges, and a second holding zone adjacent said upper short edge, whereby (c) when the interior faces of the front and rear panels are brought into facing relationship, the upraised lip of said front panel snugly embraces the upraised portions of said rear panel, and permits cohesive interbonding of the edges of both panels.

2. The case of claim 1 wherein said second rectangular holding zone has an axis of elongation perpendicular to said side edges.

3. The case of claim 1 wherein the corners of said first holding zone are recessed outwardly from the holding zone.

4. The case of claim 1 wherein the distance of separation of the interior faces of the interbonded panels and the dimensions of said first holding zone are such as to permit slight sliding movement of a sports card held within the case.

5. The case of claim 1 whereby, when two or more of the cases are stacked so that all front and rear panels are uniformly oriented, said second upraised ridge will seat upon said margin region of the next underlying case, thereby imparting lateral stability to the stack of cases.

6. The case of claim 5 wherein said second upraised ridge and margin region have a roughened texture which further promotes interlocking of the cases.

7. The case of claim 1 containing a sports card and a documentation card and cohesively sealed about said rectangular perimeter.

8. The case of claim 7 which encloses a minimal amount of gaseous material deleterious to said sports card.

* * * * *